US012622566B2

(12) United States Patent
Brewer et al.

(10) Patent No.: US 12,622,566 B2
(45) Date of Patent: May 12, 2026

(54) NON-RADIATING PUMP COVER

(71) Applicants: Haier US Appliance Solutions, Inc., Wilmington, DE (US); The Ohio State University, Columbus, OH (US)

(72) Inventors: Kyle James Brewer, Louisville, KY (US); Scott Allen Noll, Blacklick, OH (US); Kemper York, Columbus, OH (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 94 days.

(21) Appl. No.: 18/596,153

(22) Filed: Mar. 5, 2024

(65) Prior Publication Data

US 2025/0281019 A1 Sep. 11, 2025

(51) Int. Cl.

| | |
|---|---|
| ***A47L 15/42*** | (2006.01) |
| ***F04D 29/40*** | (2006.01) |
| ***F04D 29/66*** | (2006.01) |

(52) U.S. Cl.

CPC ..... *A47L 15/4225* (2013.01); *F04D 29/406* (2013.01); *F04D 29/669* (2013.01)

(58) Field of Classification Search

None

See application file for complete search history.

(56) References Cited

U.S. PATENT DOCUMENTS

| | | | | |
|---|---|---|---|---|
| 5,637,938 | A | 6/1997 | Vukorpa et al. | |
| 2004/0055410 | A1 | 3/2004 | Rosenbauer et al. | |
| 2009/0173368 | A1 | 7/2009 | Bragg | |
| 2011/0182734 | A1* | 7/2011 | Tarui | F04D 7/04 416/144 |
| 2016/0327048 | A1 | 11/2016 | Xu | |

FOREIGN PATENT DOCUMENTS

| | | | |
|---|---|---|---|
| CN | 108113614 | A | 6/2018 |
| CN | 208203594 | U | 12/2018 |
| CN | 110552874 | A | 12/2019 |
| CN | 108711998 | B | 11/2020 |
| DE | 19739613 | B4 | 5/2006 |

* cited by examiner

*Primary Examiner* — Levon J Shahinian

(74) *Attorney, Agent, or Firm* — Dority & Manning, P.A.

(57) ABSTRACT

A dishwasher pump assembly includes a pump cover configured to reduce the amount of noise transmitted by the cover during operation of the pump. The radiating efficiency of the cover is reduced by reducing the solid percentage of the pump cover. In doing so, the geometry of the pump cover may be modified to inefficient at radiating noise.

16 Claims, 6 Drawing Sheets

NON-RADIATING PUMP COVER

FIELD OF THE INVENTION

The present disclosure relates generally to appliances, such as dishwasher appliances, and more particularly to motor covers used in such appliances.

BACKGROUND OF THE INVENTION

Many appliances utilize fluids for various purposes, such as cleaning purposes, fluid supply purposes, etc. Dishwashers, washing machines, and refrigerators are examples of such appliances. Such appliances typically include conduits for flowing fluids therethrough, both for use in the appliance and for drainage from the appliance. Additionally, pumps may be utilized to encourage fluid flow through such conduits.

Known pumps utilized with appliances typically include an impeller positioned within a housing through which the fluid flows and an electric motor positioned outside of the housing coupled to the impeller to impart rotation. Pumps can vibrate due to the high rotational speed of the motor and torque pulsations at the impeller. To protect the internal components of the pump from damage or unauthorized access, pumps are often provided with one or more covers. Generally, the covers are substantially flat structures typically formed from a rigid, often fire resistant, plastic material.

In many cases, the vibration of the pump transmits vibrations to the covers, which act as a drum or speaker diaphragm and amplify the vibration. Consequentially, typical appliance pumps are noisy and, in appliances such as dishwashers, are often the main source of noise for the appliance and consumer dissatisfaction. Accordingly, appliance pumps that transmit less vibration and noise may be desirable. Covers for pumps that are relatively inefficient at transmitting vibration may be particularly useful.

BRIEF DESCRIPTION OF THE INVENTION

Aspects and advantages of the invention will be set forth in part in the following description, may be apparent from the description, or may be learned through practice of the invention.

In one exemplary aspect, a dishwashing appliance defining a vertical direction, a lateral direction, and a transverse direction is presented. The dishwashing appliance comprises a tub positioned within a cabinet and defining a wash chamber, a door pivotally mounted to the cabinet to provide selective access to the wash chamber, a rack mounted within the wash chamber and configured for receipt of articles for cleaning, a plurality of spray assemblies and a primary supply conduit is fluidly coupled to the plurality of spray assemblies. A pump assembly is fluidly coupled to the primary supply conduit, the pump assembly comprising a housing supporting an impeller for rotation within the housing, a motor coupled to the impeller to impart rotation, and a cover affixed to the housing, the cover comprising a generally planar panel having an inner surface and an outer surface, the generally planar panel comprising a plurality of apertures formed through the inner surface and the outer surface, wherein the apertures comprise between about 55% and about 75% of a surface area of the generally planar panel.

In another exemplary aspect an appliance pump assembly comprises a housing supporting an impeller for rotation within the housing, a motor coupled to the impeller to impart rotation, and a cover affixed to the housing, the cover comprising a generally planar panel having an inner surface and an outer surface, the generally planar panel comprising a plurality of apertures formed through the inner surface and the outer surface, wherein the apertures comprise between about 55% and about 75% of a surface area of the generally planar panel.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
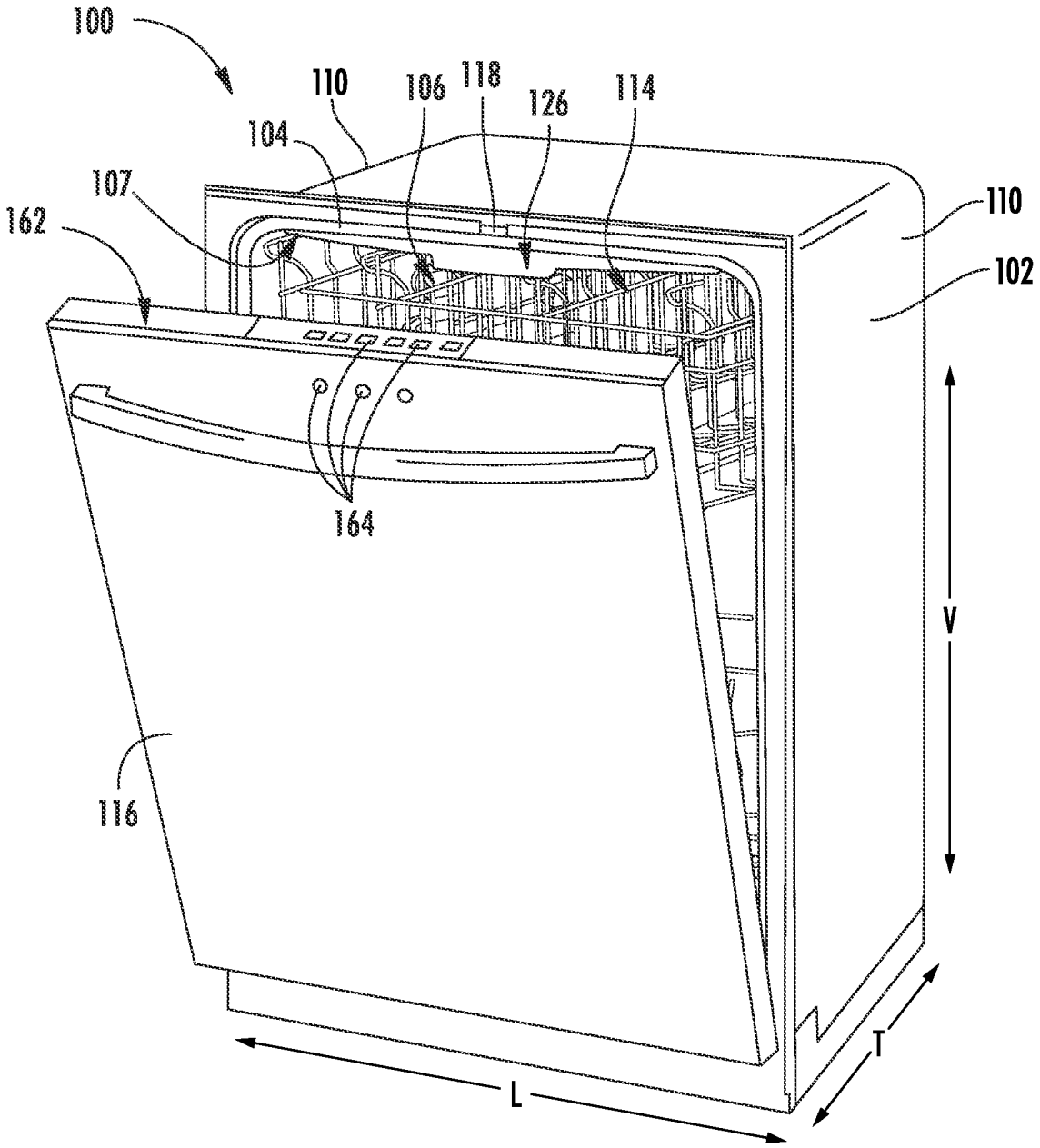
FIG. 1 provides a perspective view of an exemplary embodiment of a dishwashing appliance of the present disclosure with a door in a partially open position.

Repeated use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
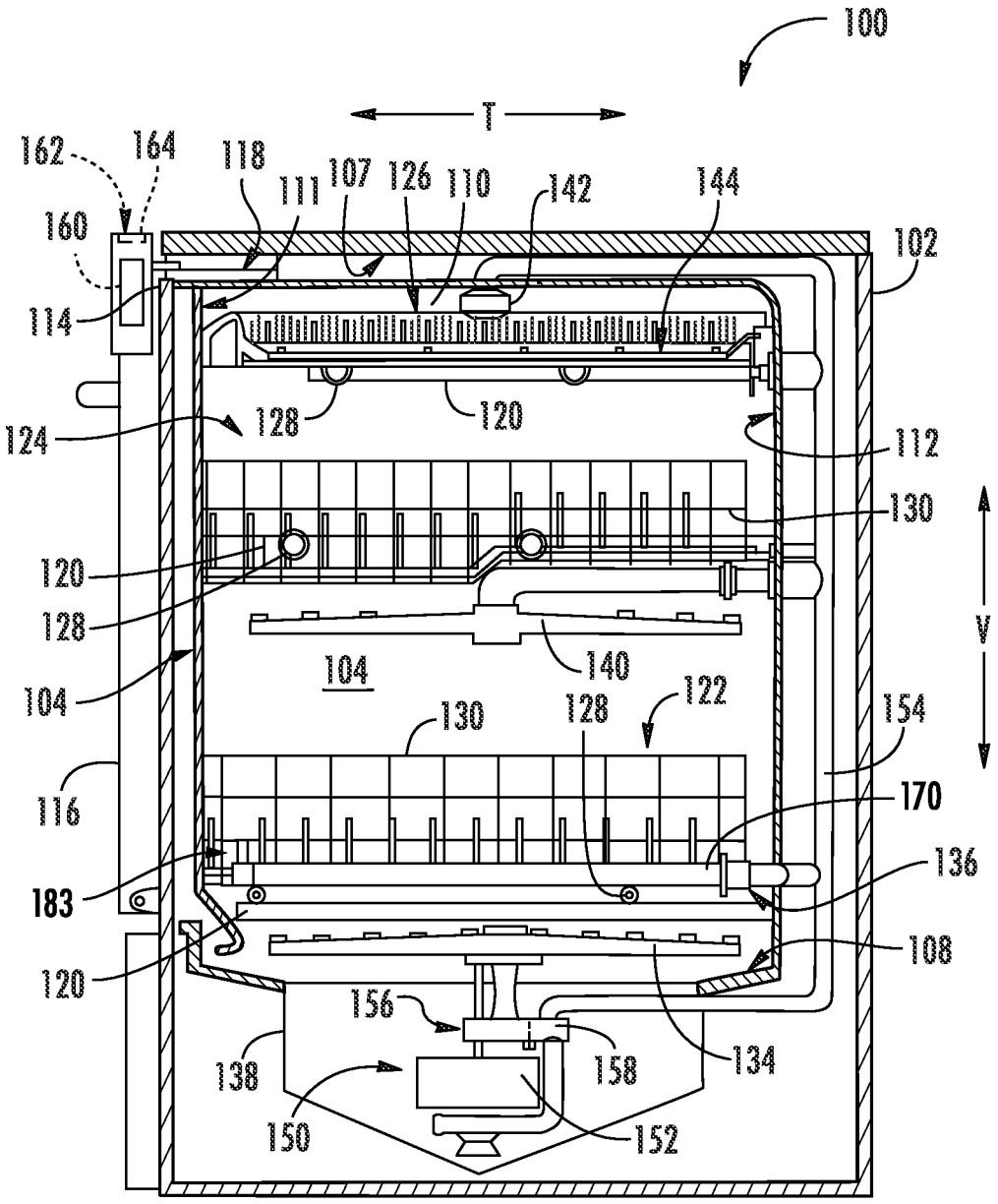
FIG. 2 provides a side, cross-sectional view of the exemplary dishwashing appliance of FIG. 1.

Turning to the figures, FIGS. 1 and 2 depict an exemplary domestic dishwasher or dishwashing appliance 100 that may be configured in accordance with aspects of the present disclosure. For the particular embodiment of FIGS. 1 and 2, the dishwasher 100 includes a cabinet 102 (FIG. 2) having a tub 104 therein that defines a wash chamber 106. As shown in FIG. 2, tub 104 extends between a top 107 and a bottom 108 along a vertical direction V, between a pair of side walls 110 along a lateral direction L, and between a front side 111 and a rear side 112 along a transverse direction T. Each of the vertical direction V, lateral direction L, and transverse direction T are mutually perpendicular to one another.

The tub 104 includes a front opening 114 and a door 116 hinged at its bottom for movement between a normally closed vertical position (shown in FIG. 2), wherein the wash chamber 106 is sealed shut for washing operation, and a horizontal open position for loading and unloading of articles from the dishwasher 100. That is, the door 116 is pivotally mounted to the cabinet 102 to provide selective access to the wash chamber 106. According to exemplary embodiments, dishwasher 100 further includes a door closure mechanism or assembly 118 that is used to lock and unlock door 116 for accessing and sealing wash chamber 106.

As best illustrated in FIG. 2, tub side walls 110 accommodate one or more rack assemblies (three shown) configured for receipt of articles for cleaning. More specifically, guide rails 120 may be mounted to side walls 110 for supporting a lower rack assembly 122, a middle rack assembly 124, and an upper rack assembly 126 for sliding motion. As illustrated, upper rack assembly 126 is positioned at a top portion of wash chamber 106 above middle rack assembly 124, which is positioned above lower rack assembly 122 along the vertical direction V. Each rack assembly 122, 124, 126 is adapted for sliding movement on the guide rails 120 between an extended loading position (second position, not shown) in which the rack is positioned at least partially outside the wash chamber 106, and a retracted position (first position, as shown in FIGS. 1 and 2) in which the rack is located inside the wash chamber 106. This is facilitated, for example, by rollers 128 mounted onto rack assemblies 122, 124, 126, respectively. Although guide rails 120 and rollers 128 are illustrated herein as facilitating movement of the respective rack assemblies 122, 124, 126, it should be appreciated that any suitable sliding mechanism or member may be used according to alternative embodiments.

Some, or all, of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles, e.g., during a cleaning or rinsing cycle.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 may generally be configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging and/or cascading a flow of wash fluid downward over rack assemblies 122, 124, and 126. As further illustrated in FIG. 2, upper rack assembly 126 may further define an integral spray manifold 144, which is generally configured for urging a flow of wash fluid substantially upward along the vertical direction V through upper rack assembly 126.

The various spray assemblies and manifolds described herein may be part of a fluid distribution system or fluid circulation assembly 150 for circulating water and wash fluid in the tub 104. More specifically, fluid circulation assembly 150 includes an appliance pump assembly, pump assembly 152 for circulating water and wash fluid (e.g., detergent, water, and/or rinse aid) in the tub 104. Pump assembly 152 may be located within sump 138 or within a machinery compartment located below sump 138 of tub 104, as generally recognized in the art. Fluid circulation assembly 150 may include one or more fluid conduits or circulation piping for directing water and/or wash fluid from pump assembly 152 to the various spray assemblies and manifolds. For example, as illustrated in FIG. 2, pump assembly 152 may be fluidly coupled to a primary supply conduit 154, along rear 112 of tub 104, along the vertical direction V, to supply wash fluid throughout wash chamber 106.

As illustrated, primary supply conduit 154 is used to supply pressurized wash fluid to one or more spray assemblies, e.g., to mid-level spray arm assembly 140 and upper spray assembly 142. However, it should be appreciated that according to alternative embodiments, any other suitable plumbing configuration may be used to supply pressurized wash fluid throughout the various spray manifolds and assemblies described herein. For example, according to another exemplary embodiment, primary supply conduit 154 could be used to provide pressurized wash fluid to mid-level spray arm assembly 140 and a dedicated secondary supply conduit (not shown) could be utilized to provide pressurized wash fluid to upper spray assembly 142. Other plumbing configurations may be used for providing pressurized wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from pump assembly 152 onto dishes or other articles located in wash chamber 106. The arrangement of the discharge ports, also referred to as jets, apertures, or orifices, may provide a rotational force by virtue of pressurized wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc.

In operation, pump assembly 152 draws wash fluid in from sump 138, pressurizes the fluid, and pumps it to a diverter assembly 156 which is positioned within sump 138 of dishwasher appliance. Diverter assembly 156 may include a diverter disk (not shown) disposed within a diverter chamber 158 for selectively distributing the pressurized wash fluid to the spray arm assemblies 134, 140, 142 and/or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

According to an exemplary embodiment, diverter assembly 156 is configured for selectively distributing the flow of pressurized wash fluid from pump assembly 152 to various fluid supply conduits, only some of which are illustrated in FIG. 2 for clarity. More specifically, diverter assembly 156 may include three outlet ports (not shown) for supplying pressurized wash fluid to a first conduit for rotating lower spray arm assembly 134, a second conduit for rotating mid-level spray arm assembly 140, and a third conduit for spraying upper spray assembly 142.

Figure 3:
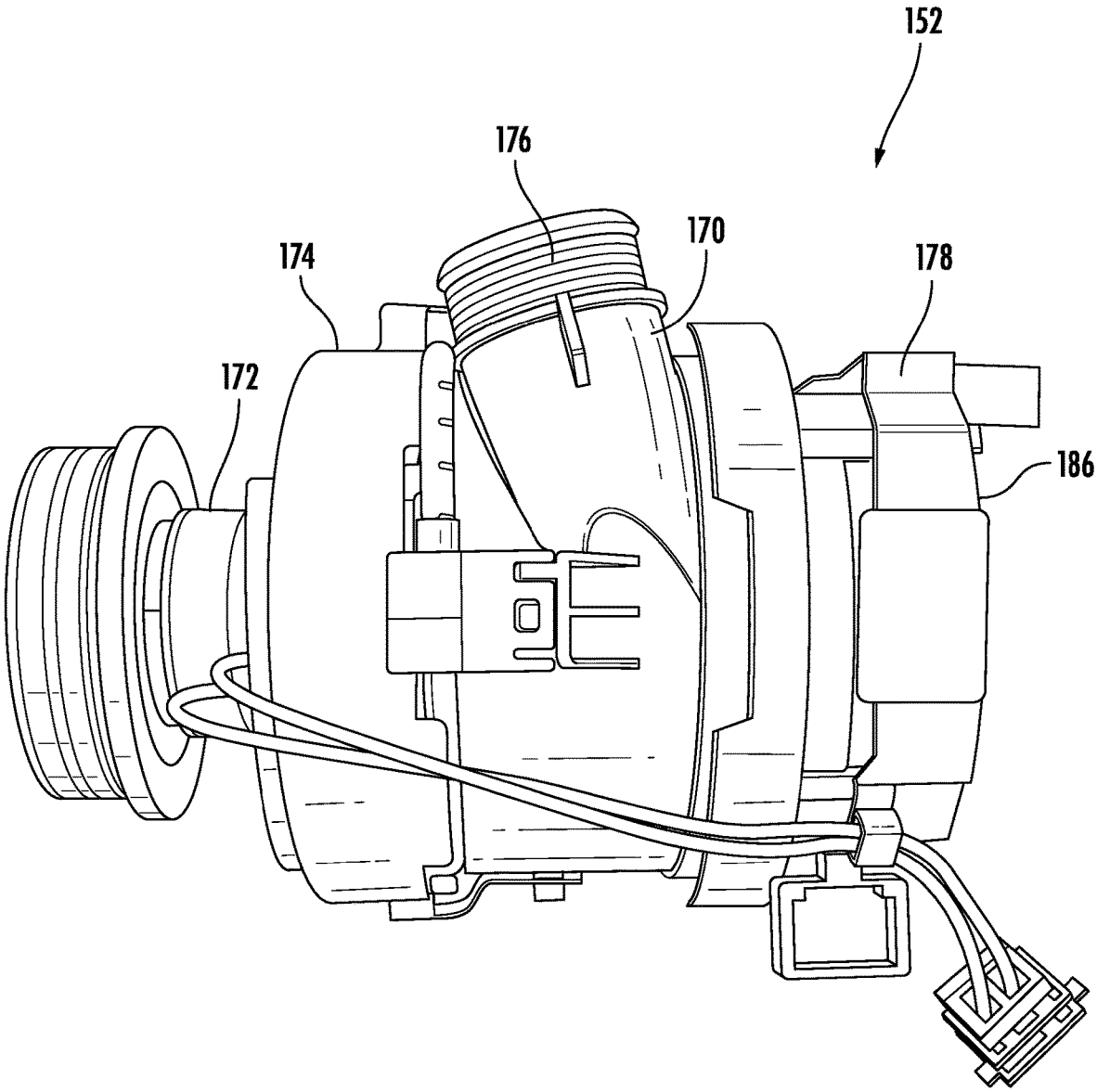
FIG. 3 provides a perspective view of a pump assembly is accordance with an embodiment of the present disclosure.

In the illustrative embodiment of FIG. 3, the pump assembly 152 comprises a pump central housing, housing 170, supporting an impeller (not shown) for rotation within the housing. A motor 172 is adapted to be coupled to the housing 170 such that the motor is coupled to the impeller to impart rotation to the impeller. In particular the rotor, or shaft, of the motor 172 is coupled to the impeller and imparts a torque to urge the impeller to move a volume of fluid, for example wash fluid, through a pump outlet 176. As illustrated in FIG. 3, a front cover 174 is disposed over a portion of the motor 172 and may be removably fixed to a first side of the housing 170. The front cover 174 may also facilitate joining of the motor 172 to the housing 170 and/or the impeller.

A back panel cover, cover 178 is removably affixed to a second side of the housing 170, opposite the front cover 174. The cover 178 may be in contact with the housing 170 at a plurality of contact points 196 (3 shown in FIG. 4) which may include through holes 198. Some of the contact points may be adapted for removably attaching the cover 178 to the housing 170. In some embodiments, a plurality of fasteners, for example threaded fasteners such as screws, may be used to secure the cover 178 to the housing 170, the fasteners passing through the through holes 198 to engage with the housing 170. In some embodiments, at some, or all, contact points, an energy absorbing material 200 (FIG. 4) may separate the cover 178 from the housing 170, for example to isolate the cover from vibrations generated at the housing 170 or motor 172.

Figure 4:
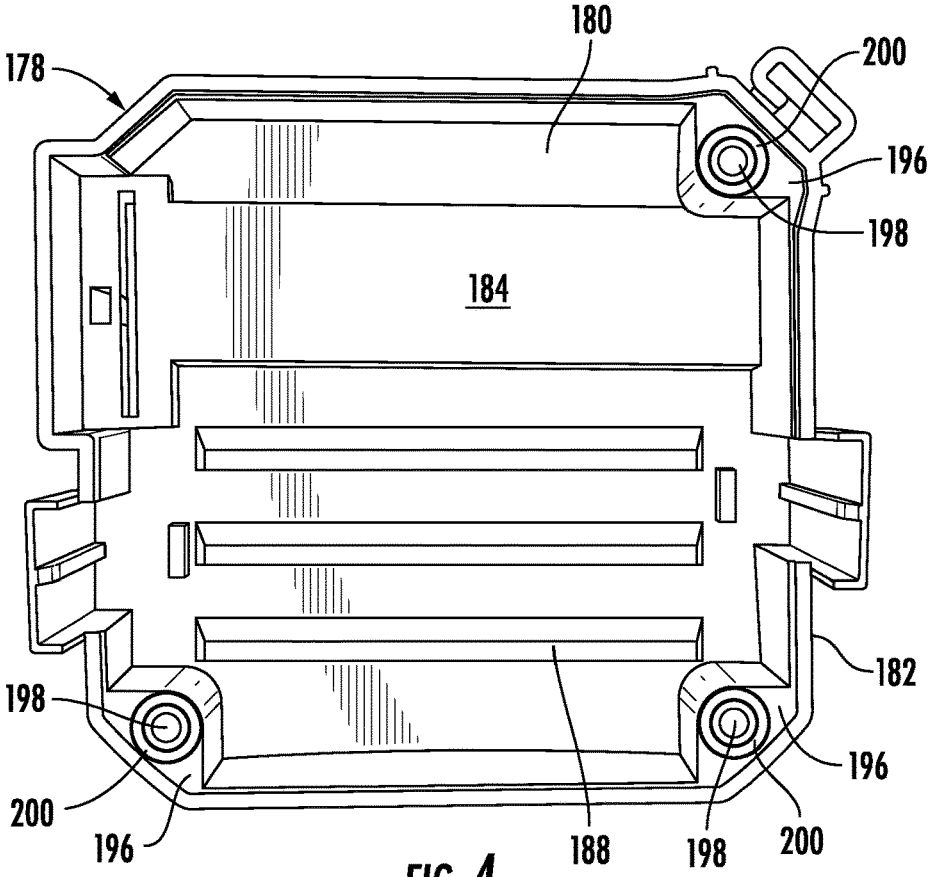
FIG. 4 provides a plan view of a cover in accordance with an embodiment of the present disclosure.
Figure 5:
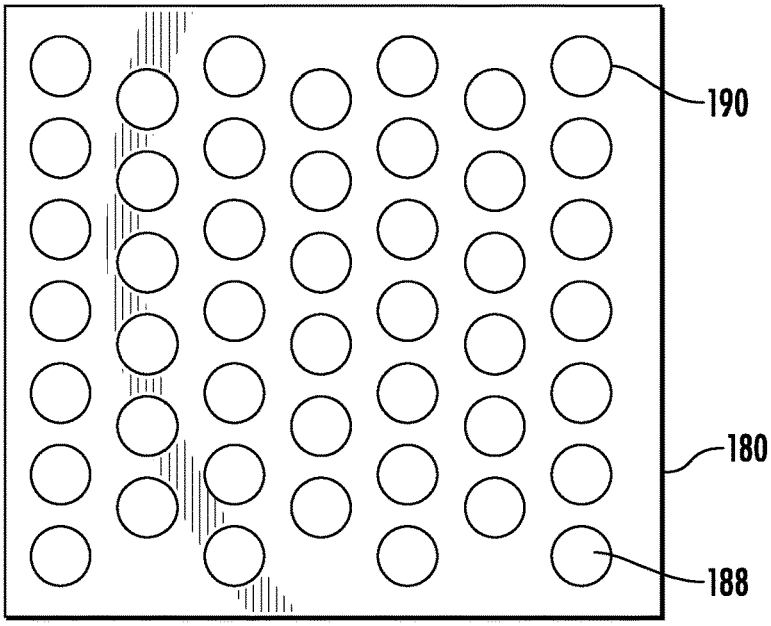
FIG. 5 provides a plan view of a panel in accordance with an embodiment of the present disclosure.

Moving to FIGS. 4 and 5, the cover 178 comprises a generally planar panel 180 generally centrally located within the perimeter 182 of the cover 178. The panel has an inner surface 184 and an opposite outer surface 186 defining a surface area of the panel 180, the surface area corresponding generally to the planar portion of the cover 178. In the illustrated embodiment, the generally planar panel 180 defines one or more apertures 188 formed through the panel 180, that is through the inner surface 184 and the outer surface 186. In embodiments, the one or more apertures 188 may comprise between about 55% and about 75% of the surface area, or between about 60% and about 70% of the surface area, or about 65% of the surface area.

In FIG. 4, the apertures 188 are linear slots and may be parallel linear slots as illustrated. In another exemplary embodiment illustrated in FIG. 5, the apertures 188 may comprise a plurality of circular holes 190. The circular holes 190 may be formed in a plurality of rows and in some embodiments, the rows may be linear parallel rows. As illustrated, the circular holes 190 in adjacent parallel rows may be offset in a direction parallel to the adjacent parallel rows such that the centers of the circular holes in one row do not align with the centers of the circular holes in an adjacent row in a direction perpendicular to the parallel rows. As shown in FIG. 5, the plurality of circular holes 190 may have the same diameter. In other embodiments, the circular holes 190 may have different diameters. Also as shown in FIG. 5, the circular holes are equally spaced in each row and each row is equally spaced from the adjacent row. As such, the circular holes 190 in each of the plurality of rows are equally spaced from an adjacent circular hole. In other embodiments, the circular holes 190 may be spaced differently in each row and adjacent rows may be differently spaced.

Figure 6:
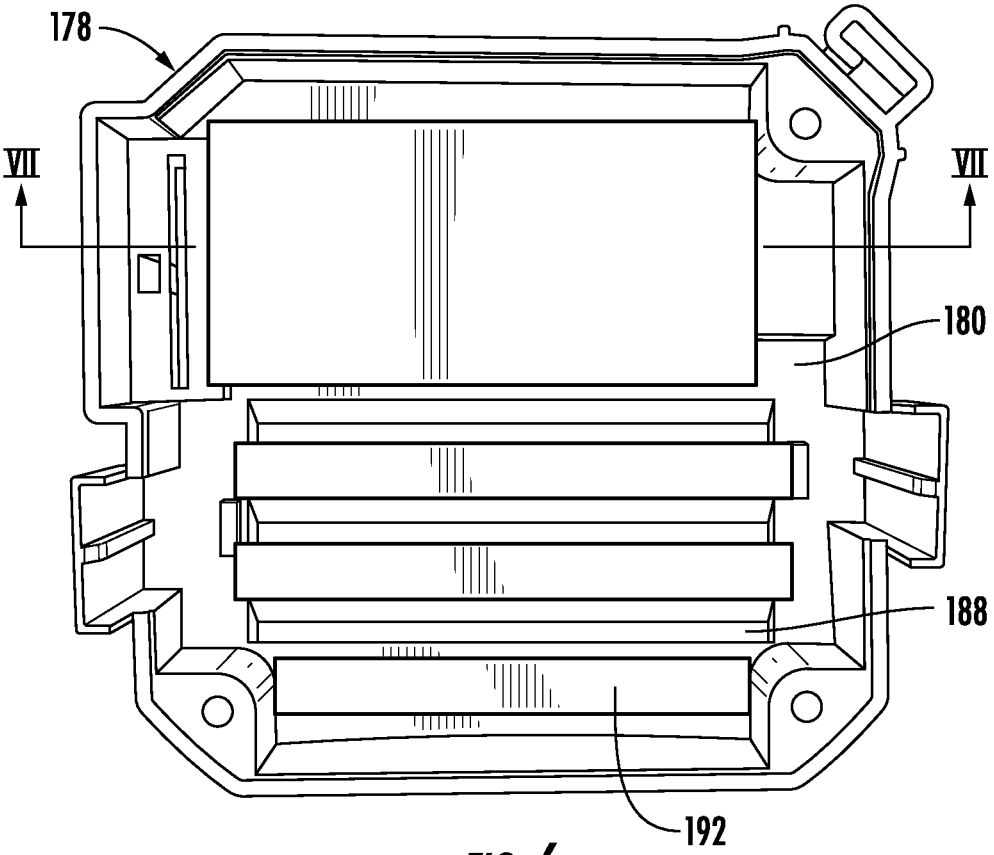
FIG. 6 provides a plan view of the cover of FIG. 4 with damping treatment applied in accordance with an embodiment of the present disclosure.
Figure 7:
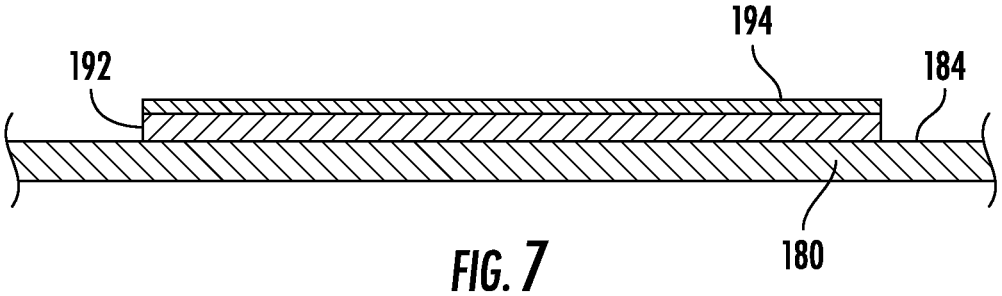
FIG. 7 provides a sectional view of the cover of FIG. 6 taken along VI-VI.

In some embodiments, a damping treatment is applied to a portion of the inner surface 184 of panel 180. For example, as illustrated in FIGS. 6 and 7, the damping treatment may comprise a layer of a viscoelastic material 192 applied to the inner surface 184. The viscoelastic material 192 exhibits both viscous characteristics and elastic characteristics and may be used as a damping material. The damping treatment may also comprise constrained-layer damping. Constrained-layer damping comprises a viscoelastic damping layer 192 applied to a portion of the inside surface 184 and a constraining layer 194 applied to the viscoelastic damping layer 192. In some embodiments, the constraining layer 194 may be a metallized layer. In other embodiments, the constraining layer may be a fiber layer, for example a woven material, applied to the viscoelastic layer 194.

The constraining layer 194 may include apertures 188 corresponding to the apertures formed in the panel 180. The apertures in the constraining layer may correspond in number, size, and positioning such that the apertures 188 in the panel 180 such that, when the constraining layer is applied, the apertures 188 remain open, or substantially open. In other embodiments, as illustrated in FIG. 6, the viscoelastic layer 192 is discretely applied to the solid portions of the panel 180, that is the portions of the panel 180 between the apertures 188.

Figure 8:
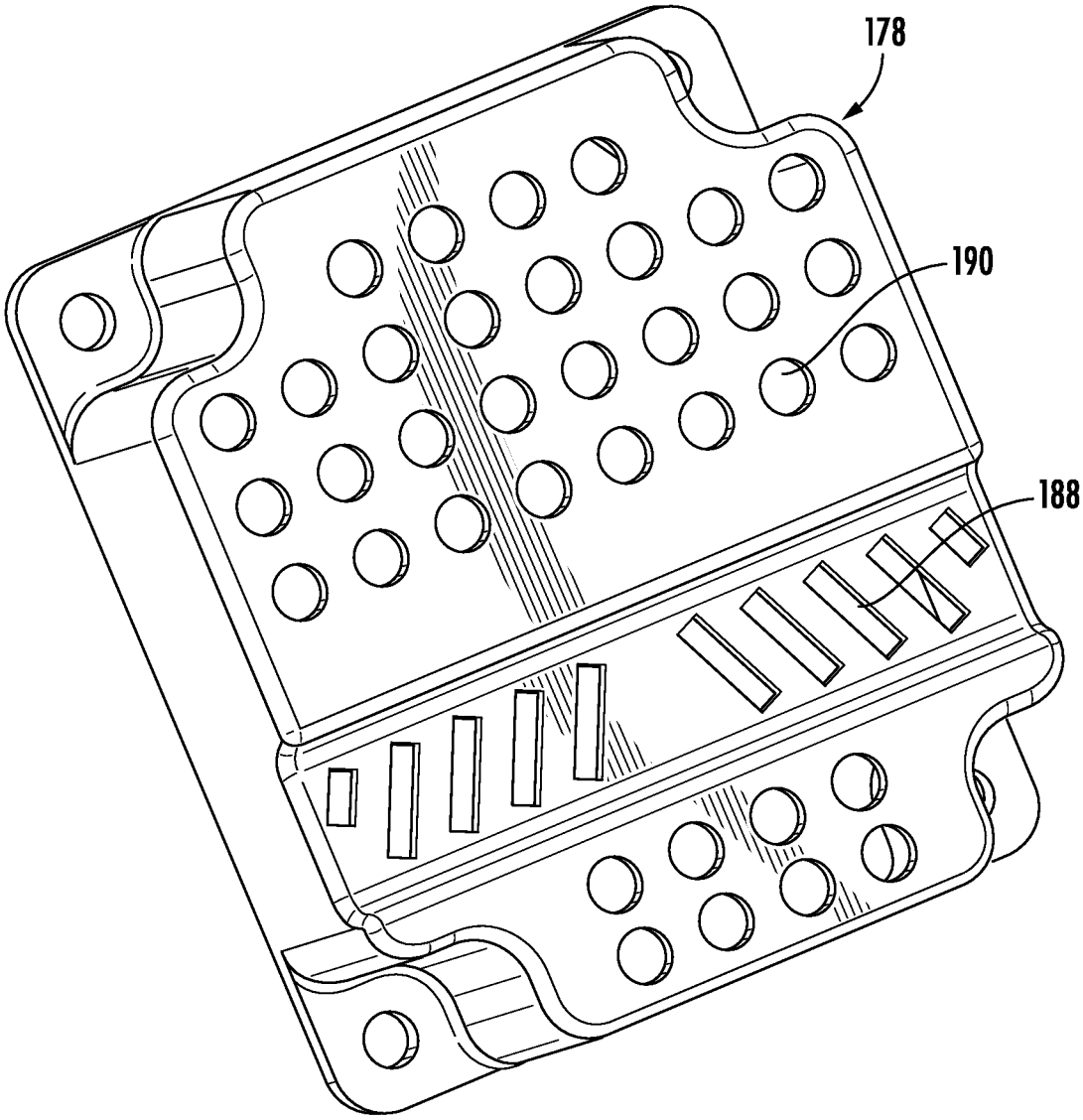
FIG. 8 provides a perspective view of another cover in accordance with an embodiment of the present disclosure.

The apertures 188 described above as linear slots and circular holes are provided as examples of apertures, and not to limit the shapes or orientations of apertures. One of ordinary skill in the art will recognize that apertures of different shapes or orientations than those illustrated would have similar beneficial results. For example, FIG. 8 is illustrative of aperture patterns and panel 180 construction in accordance with the present disclosure. FIG. 8 is illustrative of a cover 178 defining a plurality of apertures 188 and circular holes 190. The apertures 188 and circular holes 190 reduce the solid surface area of the panel 180 to negatively impact the sound transmission efficiency of the cover 178.

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 160 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area 162 of door 116 as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 includes a user interface panel/controls 164 through which a user may select various operational features and modes and monitor progress of the dishwasher 100. In one embodiment, the user interface 164 may represent a general purpose I/O ("GPIO") device or functional block. In one embodiment, the user interface 164 may include input components, such as one or more of a variety of electrical, mechanical or electro-mechanical input devices including rotary dials, push buttons, and touch pads. The user interface 164 may include a display component, such as a digital or analog display device designed to provide operational feedback to a user. The user interface 164 may be in communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for rack assemblies 122, 124, 126, different spray arm assemblies 134, 140, 142 and spray manifold configurations may be used, and other differences may be applied while remaining within the scope of the present subject matter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A dishwashing appliance defining a vertical direction, a lateral direction, and a transverse direction, the dishwasher appliance comprising:
- a tub positioned within a cabinet and defining a wash chamber;
- a door pivotally mounted to the cabinet to provide selective access to the wash chamber;
- a rack mounted within the wash chamber and configured for receipt of articles for cleaning;
- a plurality of spray assemblies;
- a primary supply conduit fluidly coupled to the plurality of spray assemblies;
- a pump assembly fluidly coupled to the primary supply conduit, the pump assembly comprising:
  - a housing supporting an impeller for rotation within the housing;
  - a motor coupled to the impeller to impart rotation; and
  - a cover affixed to the housing, the cover comprising a generally planar panel having an inner surface and an outer surface, the generally planar panel defining one or more apertures formed through the inner surface and the outer surface;
  - wherein the one or more apertures comprise between about 55% and about 75% of a surface area of the generally planar panel.

2. The dishwashing appliance of claim 1, wherein the one or more apertures comprise between about 60% and about 70% of the surface area of the generally planar panel.

3. The dishwashing appliance of claim 2, wherein the one or more apertures comprise about 65% of the surface area of the generally planar panel.

4. The dishwashing appliance of claim 1, wherein the one or more apertures comprise circular holes.

5. The dishwashing appliance of claim 4, wherein the circular holes are formed in a plurality of parallel rows.

6. The dishwashing appliance of claim 5, wherein the plurality of parallel rows are linear.

7. The dishwashing appliance of claim 5, wherein the circular holes in adjacent parallel rows are offset in a direction parallel to the adjacent parallel rows such that centers of circular holes in a row do not align with centers in an adjacent row in a direction perpendicular to the rows.

8. The dishwashing appliance of claim 4, wherein the circular holes in each of the plurality of parallel rows are equally spaced from an adjacent circular hole.

9. The dishwashing appliance of claim 1, wherein the apertures comprise a plurality linear slots.

10. The dishwashing appliance of claim 9, wherein the plurality of linear slots are parallel.

11. The dishwashing appliance of claim 1, further comprising a damping treatment applied to a portion of the inner surface.

12. The dishwashing appliance of claim 11, wherein the damping treatment comprises a layer of viscoelastic material.

13. The dishwashing appliance of claim 11, further comprising constrained-layer damping, the constrained-layer damping comprising a viscoelastic damping layer applied to the portion of the inside surface and a constraining layer applied to the viscoelastic damping layer.

14. The dishwashing appliance of claim 13, wherein the constraining layer includes apertures corresponding to the apertures formed in the generally planar panel.

15. The dishwashing appliance of claim 13, wherein the constraining layer is a metallized layer.

16. The dishwashing appliance of claim 13, wherein the constraining layer is a fiber layer.

* * * * *